US006435745B1

(12) United States Patent
Yamada

(10) Patent No.: US 6,435,745 B1
(45) Date of Patent: Aug. 20, 2002

(54) IMAGE FORMING APPARATUS HAVING AUXILIARY TRAY

(75) Inventor: Akira Yamada, Kawasaki (JP)

(73) Assignee: Fujitsu Limited, Kawasaki (JP)

( * ) Notice: Subject to any disclaimer, the term of this patent is extended or adjusted under 35 U.S.C. 154(b) by 0 days.

(21) Appl. No.: 09/539,628

(22) Filed: Mar. 31, 2000

(30) Foreign Application Priority Data

Sep. 1, 1999 (JP) ..... 11-247561

(51) Int. Cl.[7] ..... B41J 11/58
(52) U.S. Cl. ..... 400/624; 400/613
(58) Field of Search ..... 400/624, 595, 400/596, 601, 602, 608.2, 608.4, 613; 347/102; 101/487

(56) References Cited

U.S. PATENT DOCUMENTS 4,728,963 A * 3/1988 Rasmussen et al. ..... 346/25
4,844,633 A * 7/1989 Greenberg ..... 400/120
5,366,216 A * 11/1994 Ahlvin ..... 271/171
5,921,690 A * 7/1999 Shinmachi et al. ..... 400/625
6,070,868 A * 6/2000 Nagato et al. ..... 271/45
6,106,178 A * 8/2000 Chiu ..... 400/624
6,179,499 B1 * 1/2001 Beretta et al. ..... 400/605

FOREIGN PATENT DOCUMENTS

JP 11-5664 1/1999

OTHER PUBLICATIONS

HP DeskJet 850C for Macintosh.

* cited by examiner

*Primary Examiner*—Daniel J. Colilla
*Assistant Examiner*—Darius N. Cone
(74) *Attorney, Agent, or Firm*—Armstrong, Westerman & Hattori, LLP

(57) ABSTRACT

An image forming apparatus has an image forming device such as a printing head, a conveyor device for conveying a paper sheet past the image forming device in the conveying direction, a exit tray, and an auxiliary tray disposed above the exit tray and movable in the direction parallel to the conveying direction. The auxiliary tray is moved by the drive mechanism of the conveyor device, so that the auxiliary tray moves outward when the sheet is conveyed, and is returned when the next sheet is picked up. The printed sheet is temporarily supported by the auxiliary tray and then falls onto the exit tray.

10 Claims, 5 Drawing Sheets

IMAGE FORMING APPARATUS HAVING AUXILIARY TRAY

BACKGROUND OF THE INVENTION

1. Field of the Invention

The present invention relates to an image forming apparatus such as an ink jet printer and a medium exit device therefor.

2. Description of the Related Art

An image forming apparatus is provided with an image forming means and a medium conveyor device. For instance, a printer has a printing head to execute a printing operation and a conveyor device for conveying a medium (such as a paper sheet) in a predetermined direction past the printing head. The conveyor device comprises, for example, of a pickup roller, a feed roller and an exit roller, and a drive mechanism for driving such rollers is provided. The drive mechanism of the conveyor device generally comprises a motor and a gear train for transmitting the rotation of the motor to the conveyor rollers. The printer further comprises an exit tray (or a stacker) for receiving the printed medium. The printed media are stacked, on the exit tray, one on another.

In a printer, particularly in an ink jet printer, the printing operation is carried out by imparting a liquid ink to the medium. The ink imparted to the medium is gradually absorbed by the medium and dried. As the printing speeds of printers becomes faster, however, the time interval from an instant at which one medium is stacked on the exit tray to an instant at which a next medium is placed on the preceding medium, becomes shorter, with a result that a next medium is conveyed to the discharge tray before the ink of the medium at the top of the stacked media is sufficiently dried. If the next medium conveyed contacts the medium at the top of stacked media on the tray and rubs against the latter, the printed surface of the latter might become dirty and the quality of printing may be deteriorated if the ink on the medium on the tray is not sufficiently absorbed.

To solve such a problem, a printer having an exit tray and an auxiliary tray is proposed (for example, in Japanese Unexamined Patent Publication (Kokai) No. 11-5664). The exit tray and the auxiliary tray are located outside the casing of the printer, so that the auxiliary tray is disposed above the exit tray. The auxiliary tray comprises a plurality of tray elements adapted to be movable in the direction transverse to the sheet conveying direction. The conveyed paper sheet is temporarily placed on the auxiliary tray and then falls onto the exit tray when the auxiliary tray moves in the transverse direction, and is stacked on the exit tray. Next, the auxiliary tray returns to the original position onto which the subsequent paper sheet is conveyed and temporarily placed. These steps are repeated thereafter. By temporarily placing the paper sheet on the auxiliary tray, it is possible to provide a longer time period until this paper sheet is brought into contact with the sheet already stacked on the exit tray. Accordingly, the subsequent paper sheet can be placed on the preceding paper sheet stacked on the exit tray after the ink of the latter has sufficiently been dried. Thus, it is possible to prevent the printed surface from becoming dirty. Also, in another aspect, the auxiliary tray comprises a plurality of tray elements rotatable about an axis parallel to the sheet conveying direction, which operation is similar to that of the previous aspect.

In the prior art, however, the auxiliary tray comprises a plurality of tray elements movable transversely to the sheet conveying direction or rotatable about an axis parallel to the sheet conveying direction. Also, a drive mechanism of the auxiliary tray is disposed outside the casing of the printer. That is, in the prior art, the auxiliary tray and the drive mechanism therefor are formed separately from the body of the printer. Thereby, according to the prior art, an overall structure of the printer including the auxiliary tray becomes complicated to result in a high production cost, and a space occupied by the printer increases as a whole. Further, the auxiliary tray of the prior art is disposed outside the casing of the printer and cannot be accommodated within the casing of the printer.

The same problems reside in image forming apparatuses other than printers.

SUMMARY OF THE INVENTION

An object of the present invention is to provide an image forming apparatus and a medium exit device capable of preventing an image forming surface of a medium from becoming dirty even at a high sheet-conveying speed.

An image forming apparatus, according to the present invention, comprises an image forming unit, a conveyor device for conveying a medium in a conveying direction through the image forming unit, an exit tray receiving the medium having an image formed thereon, and an auxiliary tray disposed above the exit tray to be movable in the conveying direction.

According to this arrangement, the auxiliary tray is located outside the body of the image forming apparatus at a position above the main tray and movable in the conveying direction between a position above the main tray and another position at which it is retracted in the interior of the image forming apparatus. When the auxiliary tray is located at the position above the tray, the image is formed (for example, by the printing of letters or pictures) and the conveyed medium is temporarily placed on the auxiliary tray. When the auxiliary tray moves to the position retracted in the body of the image forming apparatus, the medium placed on the auxiliary tray falls onto the tray and is stacked thereon. Then, the auxiliary tray returns to the original position at which the subsequent medium is conveyed and temporarily placed on the auxiliary tray.

These steps are repeated thereafter. By temporarily placing the medium on the auxiliary tray, it is possible to have a longer time period until this medium is in contact with the preceding medium already stacked on the tray, so that this medium is placed on the latter after the ink of the medium previously stacked on the tray has sufficiently been dried. Accordingly, the contamination of the printed surface is avoidable.

In the present invention, the auxiliary tray is adapted to be movable in the direction parallel to the conveying direction of the medium, and therefore, may be formed of a single plate member. The auxiliary tray can be retracted into the interior of the body of the image forming apparatus. Thus, according to the present invention, it is possible to provide an image forming apparatus simple in structure and inexpensive in production cost as well as free from the contamination of an image forming surface of a medium even at a high conveying speed.

The image forming apparatus includes a printer, a copying apparatus, a facsimile machine or others. The image formation may be carried out by the ejection of ink.

The image formation includes not only the printing of picture but also that of letters.

Any media may be employed in the present invention, provided the image formation can be carried out thereon, and includes a paper sheet. In the printing, it is possible to form an image not only on the paper sheet but also on an OHP sheet or a fabric. The medium is not limited to the above-mentioned ones but includes those made of plastic or metal.

Preferably, a drive mechanism is provided for moving the auxiliary tray in the conveying direction. In this case, the drive mechanism of the auxiliary tray is operatively coupled to a drive mechanism of the conveyor device. Accordingly, the auxiliary tray moves in association with the movement of the medium to be conveyed, and the drive mechanism for the auxiliary tray can be extremely simplified in structure. Preferably, the drive mechanism of the auxiliary tray comprises a pinion driven by the drive mechanism of the conveyor device and a rack provided in the auxiliary tray to be engageable with the pinion.

Preferably, a frictional member is disposed in the drive mechanism for the auxiliary tray so that the auxiliary tray is driven by the drive mechanism of the conveyor device and also manually movable.

Further, according to the present invention, a medium exit device is provided, which comprises a conveyor device conveying a medium, an exit tray receiving the conveyed medium, and an auxiliary tray disposed above the exit tray and movable in the medium conveying direction. This medium exit device is simple in structure and inexpensive in production cost, and has an advantage in that the image forming surface is free from the contamination even at a high conveying speed.

BRIEF DESCRIPTION OF THE DRAWINGS

The present invention will become more apparent from the following description of the preferred embodiments, with reference to the accompanying drawings, in which.

DESCRIPTION OF THE PREFERRED EMBODIMENTS

The present invention will be described in more detail below with reference to the preferred embodiments illustrated in the attached drawings.

Figure 1:
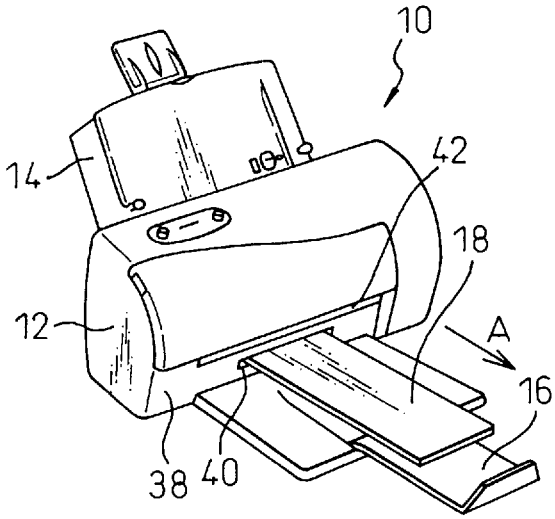
FIG. 1 is a perspective view illustrating a printer according to one embodiment of the present invention.
Figure 2:
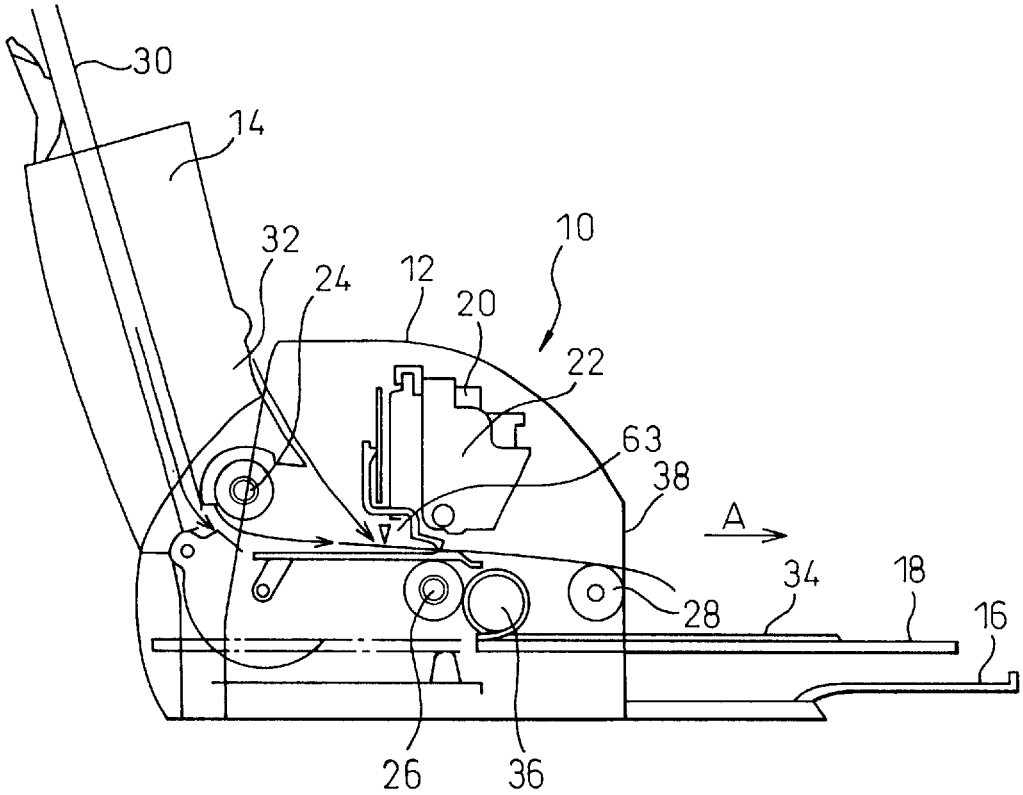
FIG. 2 is a diagrammatic sectional view of the printer in FIG. 1, illustrating the interior thereof.

FIG. 1 is a perspective view illustrating an ink jet printer according to one embodiment of the present invention, and FIG. 2 is a diagrammatic sectional view of the interior of the printer shown in FIG. 1.

The printer 10 has a printer body 12, a cut sheet feeder 14, an exit tray 16 and an auxiliary tray 18. The cut sheet feeder 14 is attached to one side of the printer body 12, and the exit tray 16 is attached to the other side of the printer body 12. The exit tray 16 and the auxiliary tray 18 are generally located outside the printer body 12, and the auxiliary tray 18 is disposed above the exit tray 16. The auxiliary tray 18 is arranged to be movable in the direction parallel to the sheet conveying direction shown by the arrow A.

The printer 10 includes a printing head 20 for carrying out a printing operation. The printing head 20 is held by a carriage 22 movable in a reciprocating manner. The printer 10 further includes a pickup roller 24, a feed roller 26 and an exit roller 28. The pickup roller 24 operates to pick up paper sheets 30, one by one, from a stack of sheets on the cut sheet feeder 14, and the feed roller 26 is located beneath the printing head 20 and conveys a paper sheet 30 in association with the exit roller 28. In this regard, a manual sheet feeder 32 is provided for manually inserting paper sheets 30, one by one, into the printer. The pickup roller 24, the feed roller 26 and the exit roller 28 are adapted to convey a paper sheet 30 in the sheet conveying direction shown by the arrow A.

The auxiliary tray 18 is formed of a single plate member with a rack 34 on the upper surface thereof. The rack 34 is moulded integral with the auxiliary tray 18. A pinion 36 is provided in the interior of the printer body 12 and meshed with the rack 34 so that the rack 34 and the auxiliary tray 18 is movable in the direction parallel to the sheet conveying direction shown by the arrow A. The rack 34 and the pinion 36 constitute a drive mechanism for the auxiliary tray 18.

As shown in FIG. 1, a side wall 38 of the printer body 12 has openings 40 and 42 wherein the auxiliary tray 18 is inserted into the opening 40, while the paper sheet 30 is discharged through the opening 42.

Figure 3:
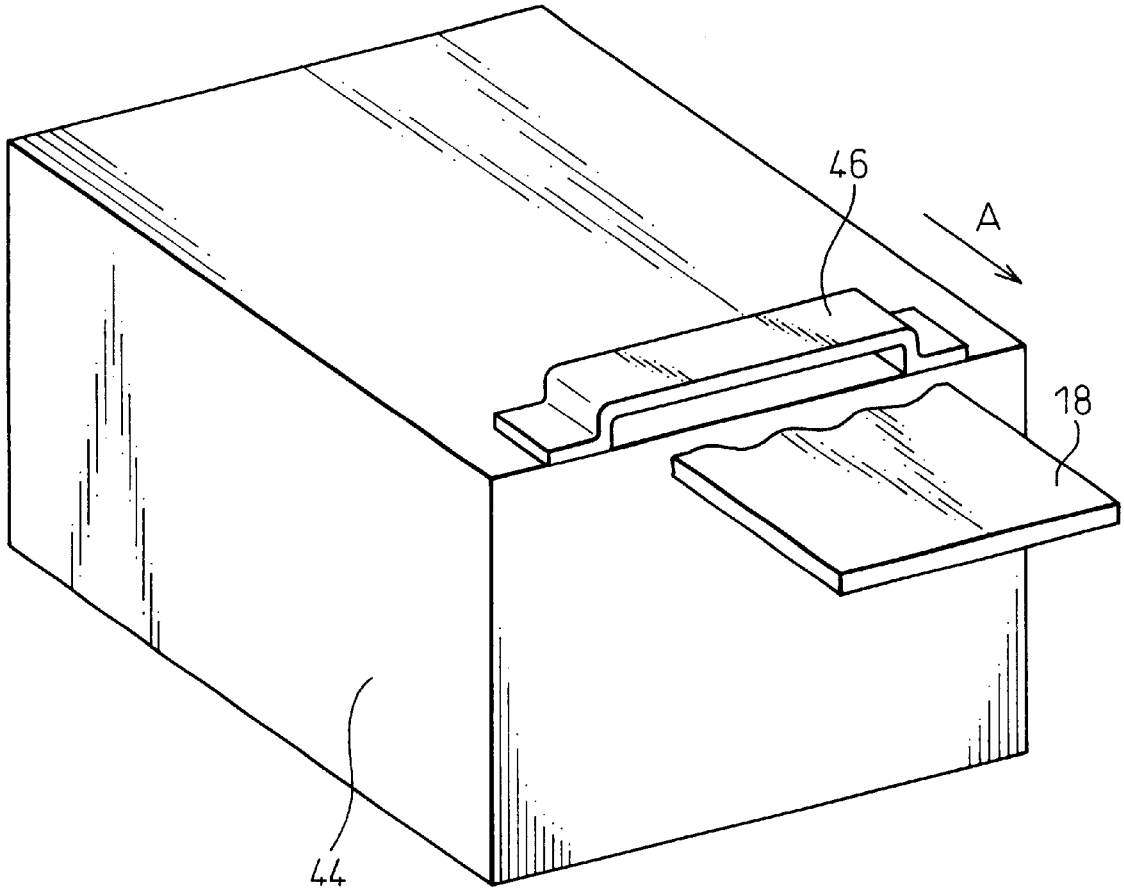
FIG. 3 is a perspective view of an embodiment of a guide for an auxiliary tray.

FIG. 3 shows an example of a guide for the auxiliary tray 18. A power source device 44 is disposed in the interior of the printer body 12 and the guide 46 is mounted to the upper wall of the power source device 44. The guide 46 is easily formed by sheet metal processing. The auxiliary tray 18 is guided by the upper wall of the power source device 44 and the guide 46 in the direction parallel to the sheet conveying direction shown by the arrow A. In this connection, the guide may be provided in any other member than the power source device 44.

Figure 4:
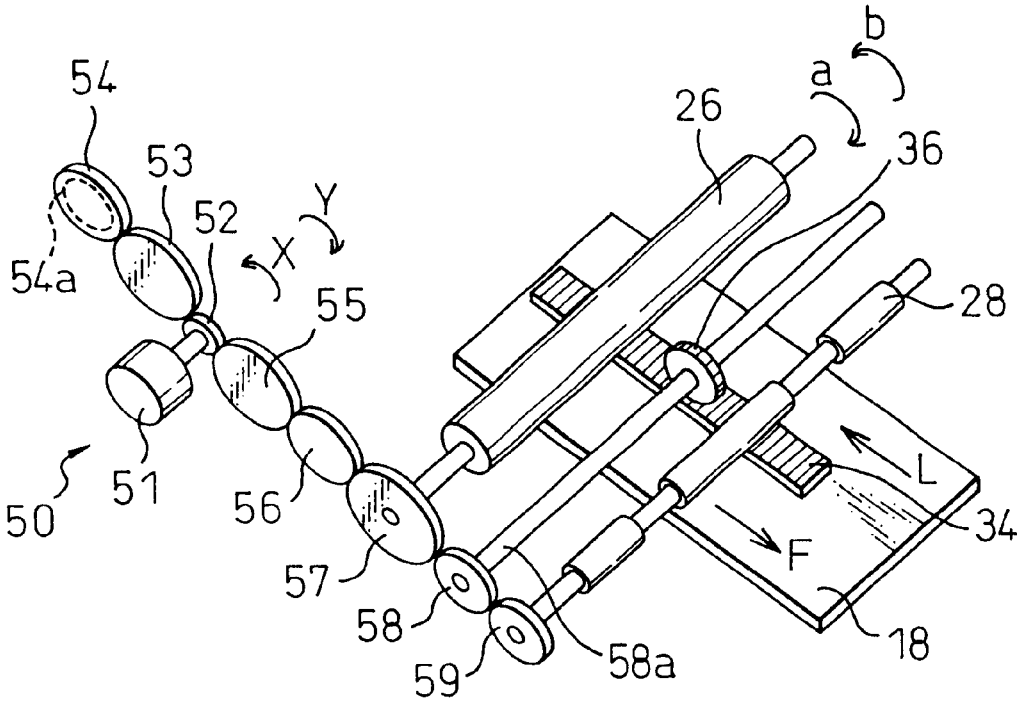
FIG. 4 is a perspective view illustrating a drive mechanism of conveyor rollers of the printer.

FIG. 4 shows a drive mechanism of the conveyor rollers of the printer 10. The drive mechanism 50 includes a motor 51 and gears 52 to 59. Gear 54 includes a one-way clutch 54*a*. The gear 54 is coupled to the pickup roller 24; the gear 57 is coupled to the feed roller 26; and the gear 59 is coupled to the exit roller 28.

A shaft 58*a* of the gear 58 extends to mount thereon the pinion 36 constituting the drive mechanism of the auxiliary tray 18. Thus, the auxiliary tray 18 is driven in synchronism with the rollers 24, 26 and 28.

Figure 5:
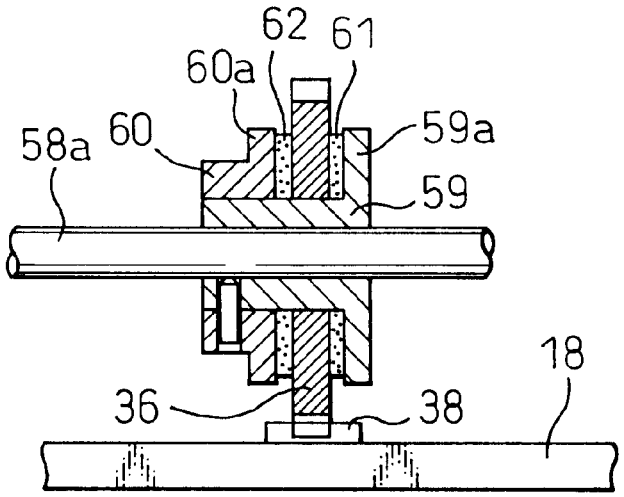
FIG. 5 is a sectional view illustrating a mounting structure of a pinion to a shaft.

FIG. 5 is a sectional view illustrating a mounting structure of the pinion 36 to the shaft 58*a*. A first cylindrical mounting member 59 is fitted and secured to the shaft 58*a*. The first cylindrical mounting member 59 has a first flange 59*a*. A second cylindrical mounting member 60 is fitted and secured to the first cylindrical mounting member 59. The second cylindrical mounting member 60 has a second flange 60*a*. The pinion 36 is rotatably fitted to the first cylindrical mounting member 59.

A frictional member 61 is disposed between the pinion 36 and the first flange 59*a*, and a frictional member 62 is disposed between the pinion 36 and the second flange 60*a*. The frictional members 61 and 62 can transmit the rotation of the shaft 58*a* to the pinion 36 by the friction. However, the frictional members 61 and 62 apply a slipping action to the pinion 36 by imparting the external force thereto to rotate the pinion 36 relative to the shaft 58*a*. Accordingly, it is possible to drive the auxiliary tray 18 by the drive 50 for the conveying device of the conveyor device as well as to manually move the auxiliary tray 18 independently of the drive 50.

A paper sensor 63 is disposed in the printer body 12 (as seen in FIG. 1). In this regard, although only one paper sensor 63 is shown in the drawings, a plurality of paper sensors may be provided.

Figure 6:
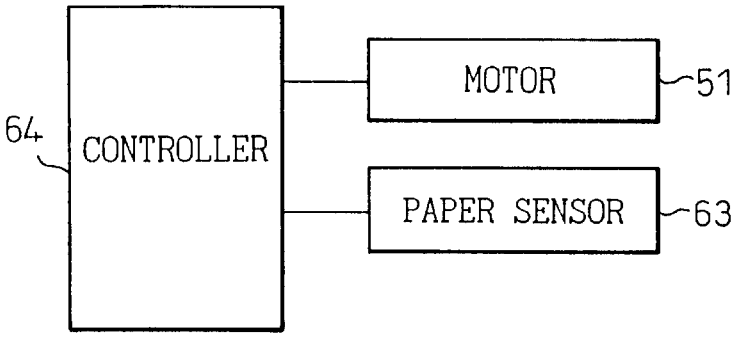
FIG. 6 is a block diagram of a structure for conveying a paper sheet.

FIG. 6 shows a block diagram for conveying a paper sheet. The printer 10 includes a controller 64. The controller 64 receives the output from the paper sensor 63 and controls the motor 51 depending on the printing command (not shown).

Figure 7:
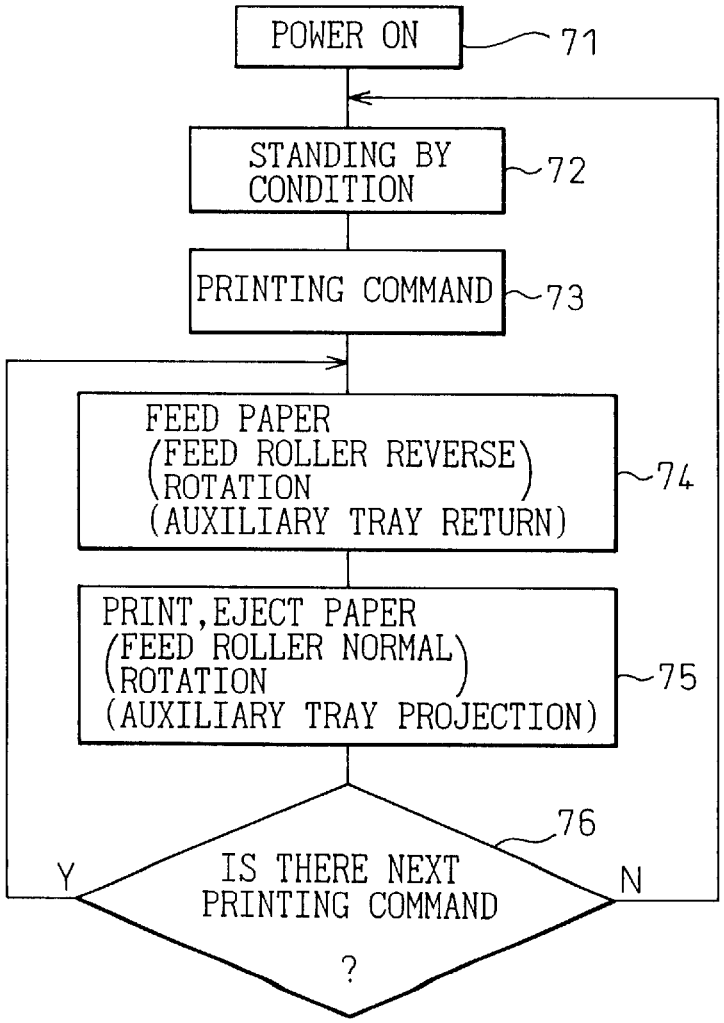
FIG. 7 is a flow chart for controlling the conveyance of paper sheet.

FIG. 7 shows a flow chart for controlling the conveyance of the paper sheet. FIG. 8 shows steps of the motion of the auxiliary tray 18. In FIG. 7, the printer 10 is switched on (power on) at step 71, and waits for the next command (standing-by condition) at step 72.

If a printing command is issued at step 73, the paper sheet 30 is picked up to feed the paper sheet at step 74. The motor 51 is a reversible motor. When the motor 51 normally rotates in the direction of arrow X shown in FIG. 4, the pickup roller 24 also normally rotates to pick one paper sheet 40 up from the cut sheet feeder 14. At this time, the feed roller 26 reversely rotates and the auxiliary tray 18 is returned into the interior of the printer body 12 as shown by arrow L in FIG. 4.

Figure 8A:
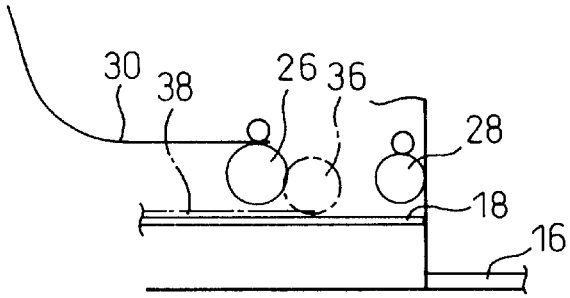
FIGS. 8A to 8E are views illustrating the motion sequence of the auxiliary tray.

The above mentioned last state is shown in FIG. 8A.

Then, the printing operation and the paper eject operation are carried out at step 75. That is, when the paper sensor 63 detects that the paper sheet 30 reaches the feed roller 26, the motor 51 reversely rotates in the direction of arrow Y shown in FIG. 4. Since the gear 54 includes the one-way clutch 54a, the reverse rotation of the motor 51 is not transmitted to the gear 54, and therefore, the pickup roller 24 does not rotate. The feed roller 26 and the exit roller 28 normally rotate to convey the paper sheet 30. The printing head 20 carries out the printing operation on the paper sheet 30. The auxiliary tray 18 starts to move outward from the printer body 12 as shown by an arrow F in FIG. 4.

Figure 8B:
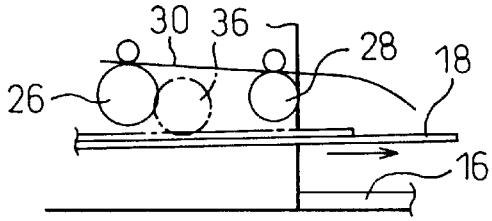
Figure 8C:
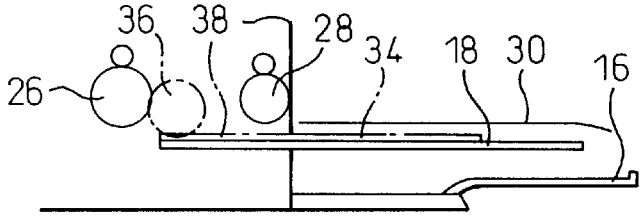

The above mentioned last state is shown in FIG. 8B. The auxiliary tray 18 continues to move outward from the printer body 12, and the printed paper sheet 30 is discharged from the printer body 12 at a position above the auxiliary tray 18. When the auxiliary tray 18 has reached the farthermost position from the printer body 12, the paper sheet 30 is completely discharged from the printer body 12 and temporarily placed on the auxiliary tray 18. This state is shown in FIG. 8C.

Figure 8D:
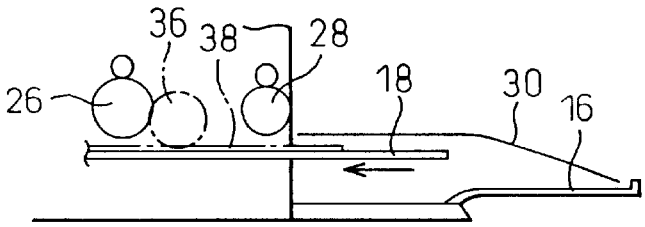
Figure 8E:
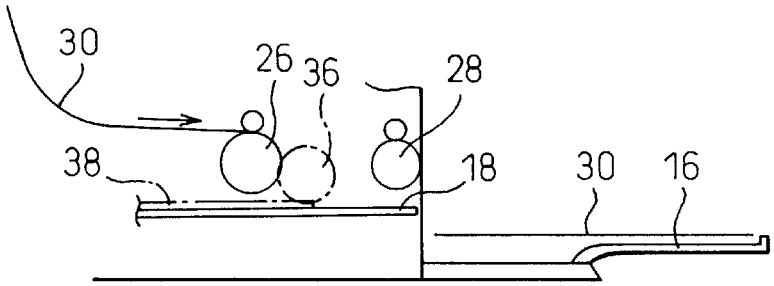

At step 76, it is determined whether or not there is a next printing command. If the answer is negative, the routine proceeds to step 72, while if the answer is affirmative, the routine proceeds to step 74. When the printing operation is continuously carried out for a plurality of paper sheets, the answer at step 76 is affirmative, and the paper sheet is fed at step 74. The feeding operation of the paper sheet carried out at step 74 is as described before; i.e., the motor 51 normally rotates and the pickup roller 24 normally rotates to pick one paper sheet 30 up from the cut sheet feeder 14, then the feed roller 26 reversely rotates to return the auxiliary tray 18 into the printer body 12. While the auxiliary tray 18 is being pulled returned the printer body 12, the leading end of the paper sheet 30 placed on the auxiliary tray 18 first hangs down toward the exit tray (as shown in FIG. 8D). As the auxiliary tray 18 is further pulled back into the printer body 12, the paper sheet 30 placed on the auxiliary tray 18 gradually falls downward, starting from the leading end to the tail end thereof. When the auxiliary tray 18 has completely been returned into the printer body 12, the paper sheet 30 on the auxiliary tray 18 is transferred as a whole to the exit tray 16 (as shown in FIG. 8E). And, when the next paper sheet 30 reaches the feed roller 26, the auxiliary tray 18 is located at the innermost position in the interior of the printer body 12. Thereafter, the operation described before in connection with step 75 is repeated.

According to this arrangement, it is possible to prevent the printed surface of the paper sheet 30 stacked on the exit tray 16 from becoming dirty even if the ink printed on the paper sheet is difficult to dry. When the auxiliary tray 18 is at a position above the exit tray 16, the paper sheet 30 which has just been printed is temporarily placed on the auxiliary tray 18 (see FIG. 8C). As the auxiliary tray 18 is returned into the printer body 12, the paper sheet 30 placed on the auxiliary tray 18 falls onto the exit tray 16 and is stacked thereon (see FIG. 8D). Then, the auxiliary tray 18 returns to the original inner position, and the printing operation is carried out on the next paper sheet. While the auxiliary tray 18 moves outward, the newly printed paper sheet is temporarily placed on the auxiliary tray 18. The above steps are repeated. By temporarily placing the paper sheet 30 on the auxiliary tray 18, it is possible to have a longer time period until this paper sheet 30 is brought into contact with the sheet 30 already stacked on the exit tray 16, so that the ink printed on the paper sheet 30 stacked on the exit tray 16 can be sufficiently dried. Thereafter, the newly printed paper sheet is stacked on the preceding paper sheet. Accordingly, contamination of the printed surface of the paper sheet on the exit tray 16 is avoidable.

It is not necessary to match the length of the auxiliary tray 18 with that of the paper sheet 30, but the length of the auxiliary tray 18 may be shorter than that of the paper sheet. Accordingly, the frictional members (frictional clutches) 61 and 62 are provided in the pinion 36 to limit the transmission of a torque of the motor 61 to the auxiliary tray 18, and a stop is provided in the auxiliary tray 18 to limit the range of movement thereof.

In this regard, when the printing has been carried out solely on a single sheet or finally on the last sheet in a plurality of paper sheets, the auxiliary tray 18 is waiting while projecting from the printer body 12 because no sheet feeding is carried out thereafter. However, the paper sheet 30 can be taken from the auxiliary tray 18. Also, it is possible to manually push the auxiliary tray 10 into the printer body 12 (while overcoming the friction of the frictional members (frictional clutches) 61 and 62 of the pinion 36), if desired, for example, when the printer 10 is not used or when the auxiliary tray 18 is obstructive.

In the aspect shown in FIG. 8B, the auxiliary tray moves outward in synchronism with the ejection of the paper sheet. However, the paper sheet may be discharged after the extension of the tray has been completed.

In the above embodiment, the tray moves in a direction parallel to the sheet conveying direction. The movement of the tray, however, should not be limited to a strictly parallel movement. In addition, the auxiliary tray must not move parallel to the exit tray or the sheet conveying direction unless the just printed sheet is in contact with the previous sheet stacked on the exit tray, but may move or be positioned obliquely to the exit tray or the sheet-conveying direction.

Printing is carried out on the paper sheet in the above embodiment. However, the medium to be printed is not limited to the paper sheet but may include an OHP sheet and a sheet made of plastic, fabric, wood, metal or others. In other words, any media on which images are formed may be used.

A term "image formation" used in this text relates not only to the formation of images pictures but also to letters and printed characters.

While the present invention has been described with reference to the application to a printer, it should not be limited thereto but may include an application to other image forming apparatuses such as a facsimile machine or a copying apparatus.

As described above, according to the present invention, a structure capable of preventing the deterioration of the image forming quality (grade of printed letters) due to the sheet eject operation can be easily realized at a low cost. Since the auxiliary tray is associated with the conveyor rollers, an exclusive drive such as a motor could be eliminated for driving the auxiliary tray. As described and illustrated in the embodiment, it is possible to connect the auxiliary tray to the conveyor rollers via a simple mechanism constituted solely by a pinion/rack, a shaft, cylindrical members and frictional members. Alternatively, a motor independent of the one used for conveying the paper sheet may be used for this purpose. Additionally, since the auxiliary tray can be accommodated in the apparatus body, space may be saved.

What is claimed is:

1. An image forming apparatus comprising:

an image forming unit;

a conveyor device conveying a medium in a conveying direction through the image forming unit;

an exit tray receiving the medium having an image formed thereon; and an auxiliary tray disposed above said exit tray and movable in a direction parallel to the conveying direction.

2. An image forming apparatus according to claim 1, further comprising a drive mechanism moving said auxiliary tray in the conveying direction.

3. An image forming apparatus according to claim 2, wherein said conveyor device has a drive mechanism, and the drive mechanism of the auxiliary tray is operatively coupled to the drive mechanism of the conveyor device.

4. An image forming apparatus according to claim 3, wherein the drive mechanism of the auxiliary tray comprises a pinion driven by the drive mechanism of the conveyor device and a rack provided in the auxiliary tray to be engageable with the pinion.

5. An image forming apparatus according to claim 3, wherein a frictional member is disposed in the drive mechanism of the auxiliary tray so that the auxiliary tray can be driven by the drive mechanism of the conveyor device and manually moved.

6. A medium exit device comprising:

a conveyor device conveying a medium;

an exit tray receiving the conveyed medium; and an auxiliary tray disposed above the exit tray and movable in the direction parallel to the medium conveying direction.

7. A medium exit device according to claim 6, further comprising a drive mechanism moving the auxiliary tray in the conveying direction.

8. A medium exit device according to claim 7, wherein said conveyor device has a drive mechanism; and the drive mechanism of the auxiliary tray is operatively coupled to the drive mechanism of the conveyor device.

9. An image forming apparatus according to claim 1 wherein a common motor is arranged both to move the auxiliary tray in and against the conveying direction and to drive the conveyor device to convey the medium.

10. The medium exit device according to claim 6, wherein a common motor is arranged both to move the auxiliary tray in and against the conveying direction and to drive the conveyor device to convey the medium.

* * * * *